United States Patent [19]

Bixler

[11] Patent Number: 4,715,529

[45] Date of Patent: Dec. 29, 1987

[54] BEAK-TYPE CARTON LOCK

[75] Inventor: Kenneth D. Bixler, Huntington, N.Y.

[73] Assignee: Packaging Corporation of America, Evanston, Ill.

[21] Appl. No.: 870,148

[22] Filed: Jul. 17, 1986

Related U.S. Application Data

[63] Continuation of Ser. No. 530,840, Sep. 9, 1983, abandoned.

[51] Int. Cl.[4] ..... B65D 1/34

[52] U.S. Cl. ..... 229/2.5 R; 229/2.5 EC

[58] Field of Search ..... 229/2.5 EC, 44 EC, 45 EC, 229/45 R, 2.5 R; 217/26.5

[56] References Cited

U.S. PATENT DOCUMENTS 3,749,235 7/1973 Boursier ..... 229/2.5 EC

*Primary Examiner*—Stephen Marcus
*Assistant Examiner*—Gary E. Elkins
*Attorney, Agent, or Firm*—Neuman, Williams, Anderson & Olson

[57] ABSTRACT

A beak-type lock particularly useful for an egg carton includes an upstanding latching member having a horizontal rib at its latching surface, which latching member is adapted to engage an orifice having a shoulder at its bottom margin and a recessed upper margin, and wherein the upper margin in the locking position falls behind a portion of the upstanding latching member to provide a double-acting lock.

9 Claims, 7 Drawing Figures

BEAK-TYPE CARTON LOCK

This is a continuation of application Ser. No. 530,840 filed Sept. 9, 1983 now abandoned.

FIELD OF THE INVENTION

The present invention relates to providing improved locking functions for molded containers and cartons, and, more particularly, to beak-type locks which combine improved strength and resistance to accidental opening.

BACKGROUND OF THE INVENTION

In the past, the carton designers of molded cartons have produced cartons with beak type locks. However, such prior designs and constructions have relatively weak engaging surfaces and are subject to rupture and failure when opening is attempted. In some instances the beak formed on the base or tray section fails and in other instances the orifice formed in the front wall of the cover section ruptures. The problem of failure and rupture was ever present in prior constructions. Although, over the years, many good designers attempted to produce improved locks, failures and ruptures still occurred and the problem was not completely solved.

Examples of prior designs appear in the U.S. Pat. Nos. to Alsman, 3,217,963; Friday, 3,245,600; Hartman, 3,276,656; Bagay, 3,459,360; and Seest et al, 3,471,078. In esch of these prior designs, developed over the years, and with practical experience, the orifice engagement surface remained simple. Seest et al. attempted to reinforce their beak with a horizontal rib at the very top thereof away from the latch engaging surface. It was not obvious to any of the prior workers in the field to provide a horizontal peripheral rib at the engaging surface or a vertical surface extending upwardly therefrom.

Many of these prior carton locks may also be relatively easily disengaged by movement of the cover section forward relative to the base section of the carton. Bagay U.S. Pat. No. 3,459,360, however, discloses the interengagement of the back of the beak with the top of the opening.

RELATED INVENTION

In U.S. Pat. No. 4,383,638, issued May 17, 1983, a beak-type lock of improved strength is provided which overcomes may of the deficiencies of the prior art such as discussed above.

A remaining problem, however, manifests itself when the aforementioned lock is used in 18-egg molded egg cartons (3 rows of 6 eggs each) which egg cartons, packed with eggs, are displayed on inclined racks with a similar loaded egg carton stacked thereabove, so that there is exerted on the front wall of the bottom egg carton a considerable force from above. Under these circumstances, the weight of the accumulated filled egg cartons above the bottom one exerts a force on the beaks of such bottom carton which, under rare circumstances, may cause the lock to accidentally become undone.

SUMMARY OF THE INVENTION

It is, accordingly, an object of the invention to overcome deficiencies in the prior art, such as indicted above.

It is another object to provide for improved locking of molded containers and cartons.

It is still another object of the invention to provide an improvement to the carton lock construction of U.S. Pat. No. 4,383,638.

It is another object of the invention to provide a beak-type lock for a molded container or carton, which lock has improved security, i.e. increased resistance to accidental opening.

It is still a further object to provide a lock which, while it has improved security, is simultaneously easier and more convenient for the consumer to open.

In accordance with the invention, a molded carton is provided with strong locks each including an upstanding relatively fixed beak-like locking member formed on the carton tray section and adapted to engage the lower margin of an orifice in the front wall of the cover of the carton. The upper margin of the orifice is constructed in relation to the upper portion of the beak so as to fall therebehind after the locking has been completed so as to provide a double-acting lock which inhibits inadvertent unlocking by providing interengagement between the back upper portion of the beak and the upper margin of the orifice.

BRIEF DESCRIPTION OF THE DRAWING

The above and other objects and the nature of the invention will be more apparent from the following detailed description of an embodiment, taken in conjunction with the drawing wherein.

DETAILED DESCRIPTION OF EMBODIMENTS

Figure 3:
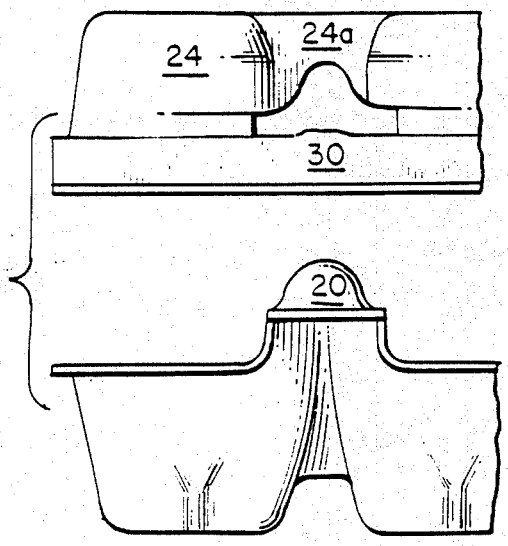
FIG. 3 is a fragmentary front view, similar to FIG. 2, showing the carton in an unlocked condition with the front wall of the cover section disposed above the front wall of the tray section.
Figure 4:
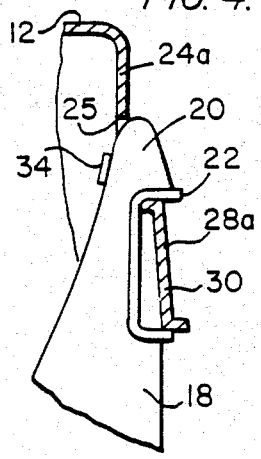
FIG. 4 is a fragmentary, partial vertical sectional view taken through the cover section along line 45—45 of FIG. 1.
Figure 5:
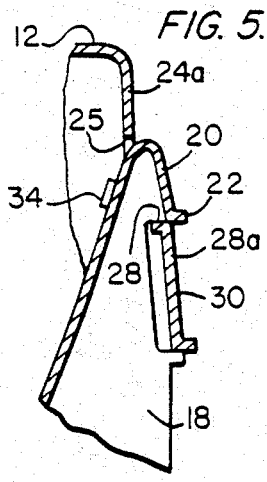
FIG. 5 is a fragmentary vertical sectional view identical to FIG. 4, but taken through both the cover section and the latch member of the tray section.

Referring to the Figures, a carton or box or container 10 formed of molded material, for example molded wood or paper pulp or thermo formed foam plastic, is shown which incorporates one embodiment of the improved beak-type lock. The carton includes an upper cover sometimes referred to as cover section 12 and a lower tray sometimes referred to as tray section 14 which is hingedly connected at its rear to the cover 12. The tray 14 has a front wall 16 recessed inwardly at 18 to define on the interior thereof one or more pockets or cells for accommodating eggs or the like. Extending upwardly from the inwardly recessed portion 18 is a latching member or beak 20 which generally conforms in structure to that shown in U.S. Pat. 4,383,638, mentioned above. As best shown in FIGS. 3 and 5, the beak 20 assumes a fixed position relative to the remainder of the tray section and is substantially hollow with side walls which taper downwardly and outwardly from the top of the beak to an integral horizontal peripheral rib or flange 22 rounded at the top and sides thereof.

Figure 1:
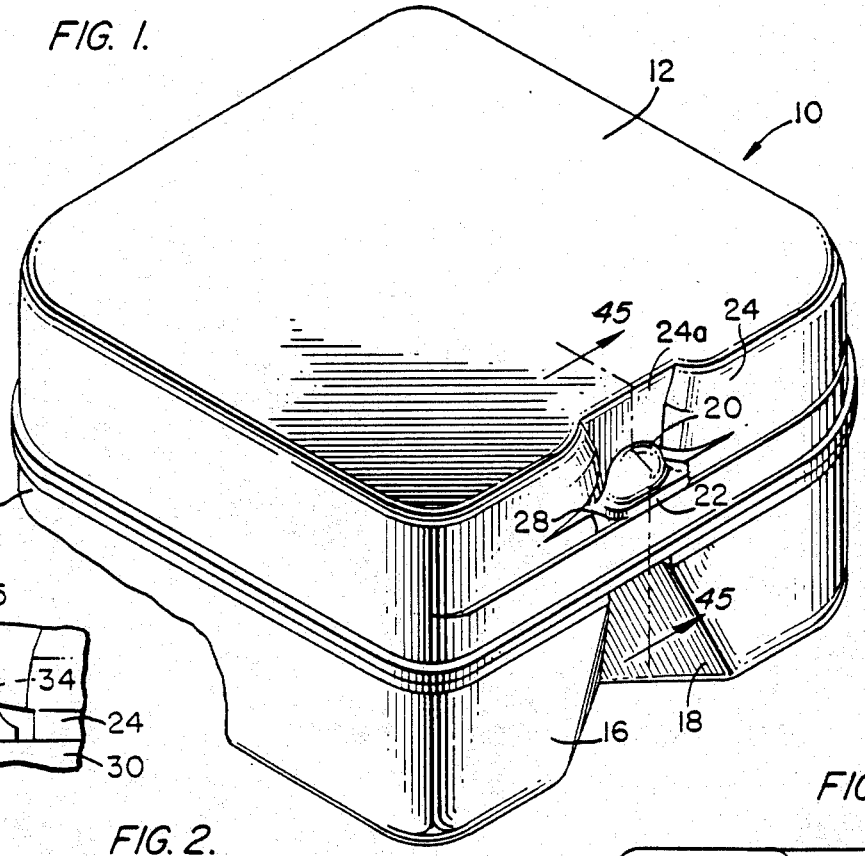
FIG. 1 is a view in perspective of a receptable (e.g. box or container or carton) illustrating an embodiment of the beak-type lock or latch which extends upwardly from the wall of the tray or bottom section of the carton through an orifice or opening in the front wall of the cover section thereof.
Figure 2:
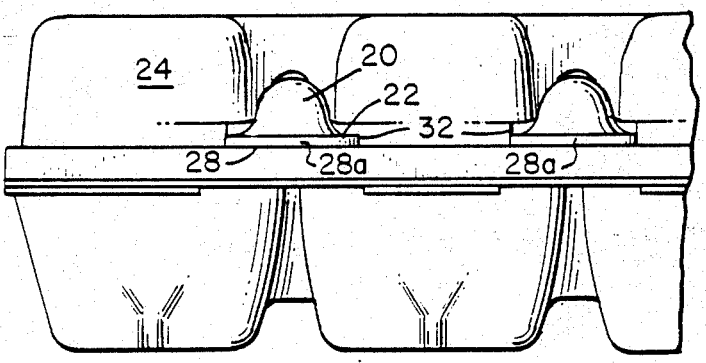
FIG. 2 is a fragmentary front view of a closed and locked egg carton having two locking elements, the locking elements corresponding to the embodiment of FIG. 1.

The cover 12, in turn, is formed with a front wall 24 which may be scalloped such as shown in FIGS. 2 and 3, or which may otherwise have one or more suitable indented or depressed areas 24a within which is formed an orifice or female or latching formation 26 adapted to cooperate with the male latching member or beak 20 to effect locking of the cover in a closed position, see FIGS. 1 and 2. The orifice 26 has a lower margin formed as a shoulder 28 with which the rib 22 of the beak 20 is adapted to engage. Such shoulder 28 may be formed with a thickened middle portion 28a to increase the contact area and also the strength of that portion 30 of the front wall 24 of the cover 12 underlying the opening 26, as will be discussed in more detail hereinafter.

In general, orifices or female locking formations according to the present invention are constructed such that, in the locking position as illustrated in FIGS. 1, 2, 4 and 5, at least a portion of the upper margin 25 of each opening, which corresponds to the lower edge of the front wall portion 24a, falls at least particularly behind the male beak 20 in such a way that to as upper margin portion 25 interferes with the top of the beak and prevents accidental or inadvertent unlatching of the carbon due to relative forward movement of the cover section 12 with respect to tray section 14.

Figure 7:
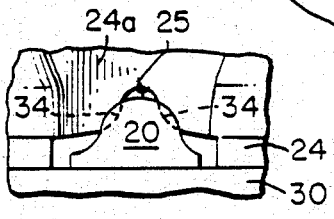
FIG. 7 is a fragmentary front elevation view similar to FIG. 6 but showing the beak-type latch member engaging the orifice in the cover front wall.
Figure 6:
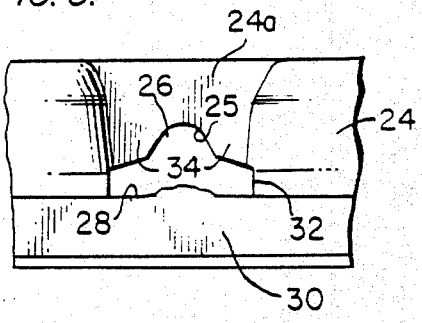
FIG. 6 is a fragmentary front elevation view of the orifice in the front wall of the cover section illustrated in FIGS. 1-5.

In the preferred embodiment, the upper margin 25, the shape of which is best seen in FIGS. 3 and 6, has a configuration which is generally complementary to the shape of the male beak 20, the central part being generally of an inverted U-shape, with the ends tapering outwardly and downwardly. As best seen in FIG. 7, however, the inverted U-shaped portion is somewhat narrower than the width of the beak 20 and therefore a pair of ears or flaps 34 are created, and it is these ears 34 which constitute the portions of the upper margin 25 falling behind the male beak 20. It will be understood, however, that other shapes and configurations are possible, e.g. the opening may be substantially rectangular with its upper edge being generally straight and parallel to the shoulder 28.

Regardless, the orifice 26 extends in and between two planes, namely a rearmost plane in which the indented portion 24a of the front wall 24 of the cover 12 lies (see FIGS. 4 and 5), and a frontmost plane defined by other portions of the front wall 24 of the cover 12, including that portion 30 sometimes referred to as a depending band which lies below the shoulder 28. Thus, two side margins 32 of the orifice 26, and the lower margin formed by the shoulder 28, are generally in the same plane, while the upper margin 25 of the orifice 26 is recessed inwardly.

On a level with the lower margin of the orifice 26 formed as the shoulder 28, at least a portion of the horizontal peripheral rib 22 of the beak 20 extends thereover when the beak 20 is in latching engagement. Formed integrally with the shoulder 28 is the depending band 30. As noted above, the thickened portion 28a of the shoulder 28 serves to enhance the effectiveness of the locking engagement.

During the locking operation, the rounded tip of the beak 20 first comes into contact with the lower portion of the depending band 30 as the cover is pivoted to a closed position causing the band to deflect outwardly; as the closing movement continues, the shoulder 28 of the cover section deflects outwardly over the beak 20 and finally over the horizontal peripheral rib 22 thereof. As this occurs, the beak 20 clears the center uppermost portion of the margin 25 and the ears 34 flex over the rounded sides of the beak 20 and come into engagement with the back of such beak, thereby providing a double-acting lock, i.e. the normal beak-locking mechanism plus the second locking effect between the back of the beak 20 and the ears 34. This double-acting lock prevents inadvertent unlocking by pressure on the beak. To effect carton opening, the user needs only to pull outwardly the depending band 30 until the shoulder 28 clears rib 22 and then pivot the cover upwardly to the open position; such a motion most users find natural. In this illustrated embodiment, the upper margin 25 of the opening 26 in the center thereof should extend above the top of the beak 20 as shown in FIG. 7 to allow the ears 34 to flex if required during closure.

The molded containers and cartons on which the latching formation in accordance with the instant invention is useful include egg cartons, food containers such as boxes for sandwiches, chicken parts, pizzas, and hamburgers in fast food operations, and other food articles and other items.

It will be understood that in accordance with the instant invention novel forms of beak-locks have been described which include latching engagement surfaces of particular formation which will resist tearing stresses and other forces encountered during closing and opening operations which may be manual or automatic. Also in accordance with the invention the latching engagement surface associated with the orifice with which the beak engages has been particularly formed so as to obviate failure due to rupture when the containers or cartons incorporating the lock are opened or closed. In particular, the male beak interacts with the female aperture in such a way as to provide a double-acting lock.

The foregoing description of the specific embodiment described will so fully reveal the general nature of the invention that others can, by applying current knowledge, readily modify and/or adapt for various applications such specific embodiment without departing from the generic concept, and, therefore, such adaptations and modifications should and are intended to be comprehended within the meaning and range of equivalents of the disclosed embodiment. It is to be understood that the phraseology or terminology employed herein is for purposes of description and not of limitation.

What is claimed is:

1. In a molded container having a tray section and a cover section hingedly connected to a rear side of said tray section for movement between an open position and a closed position, said try section having at least one fixedly positioned upstanding male latching member formed on a front side thereof, said cover section having a female latching formation formed in a front wall thereof, said container being further characterized in that the female latching formation includes a recessed upper marginal portion having a configuration which in part takes the shape of an inverted U having a closed end portion at a height at least as great as the height of said upstanding male latching member, and a width less than the width of said male latching member defining at least one flexible ear along said upper marginal portion which, in the locking position, lies behind at least a portion of said upstanding male latching member.

2. The molded container of claim 1 wherein the male latching member includes a substantially hollow upper section defined by side walls tapering outwardly, forwardly and downwardly whereby forwardly tapered portions of the side walls terminate at an integral, transversely offset reinforcing peripheral rib; said female latching formation having a transversely offset elongated lower marginal shoulder disposed forwardly of the upper marginal portion and lockingly engaging and subtending the peripheral rib of said male latching member when the cover section is in a closed position, the cover section front wall being outwardly deformable to effect clearance of the shoulder with respect to the upper section of said male latching member upon said female latching formation moving into and out of locking engagement with said male latching member.

3. The structure recited in claim 2 further characterized in that the width of said upstanding male latching member including its peripheral rib is greater than its height measured from the bottom of said peripheral rib to an uppermost point of said male latching member.

4. The structure recited in claim 2 wherein said shoulder has a thickened portion at approximately the center thereof.

5. The structure recited in claim 1, wherein the height of said inverted U is greater than the height of said male latching member.

6. The structure of claim 2 wherein the female latching formation includes an orifice through which extends the hollow upper section of the male latching member when the cover section is in a closed position with respect to the tray section, said orifice being at least partially delimited by a pair of side marginal portions substantially disposed within a plane defined by the recessed upper marginal portion of the female latching formation; said side marginal portions defining a pair of oppositely disposed ears.

7. The structure of claim 1 wherein the female latching formation includes an orifice having a segment thereof in the form of an inverted U disposed within the recessed upper marginal portion of said female latching formation, said inverted U segment having an upper portion at a height at least as great as the height of the male latching member and a width less than the width of said male latching member thereby defining at least one ear disposed behind the hollow upper section of the male latching member when the cover section assumes a closed position.

8. The structure recited in claim 7 wherein the inverted U segment of the orifice is provided with a pair of ears, one ear being formed in each side portion of said inverted U segment.

9. The structure recited in claim 6 wherein the oppositely disposed ears formed on the side marginal portions of the orifice are flexible.

* * * * *